United States Patent [19]

Noirjean

[11] Patent Number: 4,740,934

[45] Date of Patent: Apr. 26, 1988

[54] TIMEPIECE ENABLING THE HOURS OF ONE HALF OF A DAY TO BE DIFFERENTIATED FROM THOSE OF THE OTHER HALF OF THE DAY

[75] Inventor: Pierre-André Noirjean, Courfaivre, Switzerland

[73] Assignee: E.T.A. S.A., Fabriques d'Ebauches, Granges, Switzerland

[21] Appl. No.: 87,582

[22] Filed: Aug. 20, 1987

[30] Foreign Application Priority Data

Sep. 9, 1986 [CH] Switzerland ..... 03623/86

[51] Int. Cl.[4] ..... G04B 19/20; G04B 19/06

[52] U.S. Cl. ..... 368/77; 368/223; 368/233; 368/228

[58] Field of Search ..... 368/28, 35, 76, 77, 368/80, 220, 223, 228, 233

[56] References Cited

FOREIGN PATENT DOCUMENTS

| | | | |
|---|---|---|---|
| 556026 | 1/1932 | Fed. Rep. of Germany . | |
| 1478890 | 12/1939 | Fed. Rep. of Germany . | |
| 873520 | 3/1953 | Fed. Rep. of Germany . | |
| 2132540 | 1/1973 | Fed. Rep. of Germany | 368/221 |
| 7197 | 10/1893 | Switzerland . | |
| 18199 | 12/1898 | Switzerland . | |
| 22282 | 8/1900 | Switzerland . | |
| 59451 | 4/1912 | Switzerland . | |
| 453216 | 6/1968 | Switzerland . | |
| 510739 | 8/1939 | United Kingdom | 368/221 |

OTHER PUBLICATIONS

M. Th. Kuhl's, "Konstruktionssystematick bei Datumuhren" (Systematic analysis of the construction of date-watches), (Annals of the German Society for Chronometry), vol. 27 (1976), pp. 121–172.

*Primary Examiner*—Vit W. Miska

*Attorney, Agent, or Firm*—Pollock, Vande Sande & Priddy

[57] ABSTRACT

The timepiece comprises a movement (1) that rotatably drives at least an hours-hand before a dial (5). The dial (5) is formed with at least one display aperture (g1). Signs (s1, s2), which respectively represents the numbers of the hours shown by the hours-hand when the latter is in the same angular position as the display aperture (g1) a.m. and p.m., are arranged on a disc (6) which is located beneath the dial (5) and which is driven by a mechanism (7) that is connected to the movement (1). This mechanism (7) is so designed that the first and second signs (s1, s2) appear in the display aperture (g1), one a.m. (ante meridiem), the other p.m. (post meridiem). To simplify its construction, the mechanism (7) is so designed that the disc (6) will always be rotated in the same direction.

6 Claims, 5 Drawing Sheets

TIMEPIECE ENABLING THE HOURS OF ONE HALF OF A DAY TO BE DIFFERENTIATED FROM THOSE OF THE OTHER HALF OF THE DAY

BACKGROUND OF THE INVENTION

1. Field of the Invention

This invention relates to a timepiece of the kind comprising a movement, a dial, indicator means that are rotatably driven about an axis by said movement at the rate of one revolution every twelve hours and which cooperate with said dial to indicate during a first revolution the hours of a first half of a day and during a second revolution consecutive to the first revolution the hours of the second half of the day, and means for differentiating the hours of a first half of a day from the hours of the second half of the day and which include a first transparent region in said dial in a first angular position corresponding to the angular position occupied by said indicator means at a first set hour during said first half of a day and at a second set hour distant from said one set hour by a time interval of twelve hours, an element rotatable about said axis and disposed beneath said dial, a first group of signs disposed on said rotatable element facing said dial the same distance away from said axis as said first transparent region and which include a first sign representing the number of said first set hour and a second sign different from said first sign and representing the number of said second set hour, and means for driving said rotatable element that are connected to said movement and which are arranged to move said rotatable element at a first instant at the start of said first half of a day into a first position in which said first sign faces said first transparent region and at a second instant at the start of said second half of a day into a second position in which said second sign faces said first transparent region, and to maintain said rotatable element in said first position during said first half of a day and in said second position during said second half of the day.

2. Prior Art

Timepieces of the above defined kind are described in many documents such as, for instance, Swiss Patent Specifications 7197 and 18199.

An arrangement that enables one to know whether the hour shown by a timepiece is in the first or second half of a day is for instance useful when the timepiece has a calendar or an alarm which may be set to sound at any time during the twenty-four hours of a day. Such an arrangement enables a user to correctly set such a timepiece, after it has stopped, without fear of having the indications of its calendar changing at noon instead of at midnight or to have the alarm sounding twelve hours too soon or too late.

Timepieces of the above kind have hours and minutes hands that are rotatably driven before a dial by a movement at the rate of one revolution every twelve hours and of one revolution every hour respectively. The dial is not provided with the traditional signs that are used for designating hours but is formed with twelve display apertures that are located where these signs are normally to be found.

A rotary disc, lying beneath the dial, bears numbers 1 to 12 that are evenly distributed along its periphery and numbers 13 to 24 that are evenly disposed between the preceding numbers.

A mechanism that is driven by the timepiece's movement alternately moves the disc to and fro such that each of numbers 1 to 12 will be displayed through one of the apertures in the dial between 1 a.m. and 1 p.m., and that each of numbers 13 to 24 will be displayed between 1 p.m. and 1 a.m. of the next day.

In a modification of this kind of timepiece, described in Swiss Patent Specification 59451, the rotary disc bears numbers 0 to 11 that are visible from midnight till noon, and numbers 12 to 23 that are visible from noon till midnight.

In timepieces of the above kind, having a number-bearing disc that must be alternately moved to and fro complicates the construction and manufacture of the mechanism needed to produce this motion. Further, unavoidable errors in the size of the parts used in the mechanism and in their relative positioning means that it is practically impossible for the disc to move from one position to the other exactly when it should do in theory.

SUMMARY OF THE INVENTION

An object of the invention is to provide a timepiece of the above set forth kind that does not suffer from this drawback, i.e. a timepiece in which the mechanism for driving the disc bearing the numbers of the hours is simpler to achieve than in the above identified known timepieces and which will more readily ensure that the disc's movements will occur at very precise times.

This is achieved by arranging for the drive means provided in the kind of timepiece defined at the outset always to cause the rotatable element to rotate in the same direction.

SHORT DESCRIPTION OF THE DRAWINGS

In the accompanying drawings, given by way of example:

FIGS. 1A and 1B diagrammatically illustrate a first form of timepiece according to the invention, in plan and in elevation, respectively;

FIGS. 2 to 4 and 6 to 8 diagrammatically illustrate in plan other forms of timepieces according to the invention; and FIG. 5 illustrates in plan on an enlarged scale a detail of the timepiece shown in FIG. 4.

DETAILED DESCRIPTION

Figure 1A:
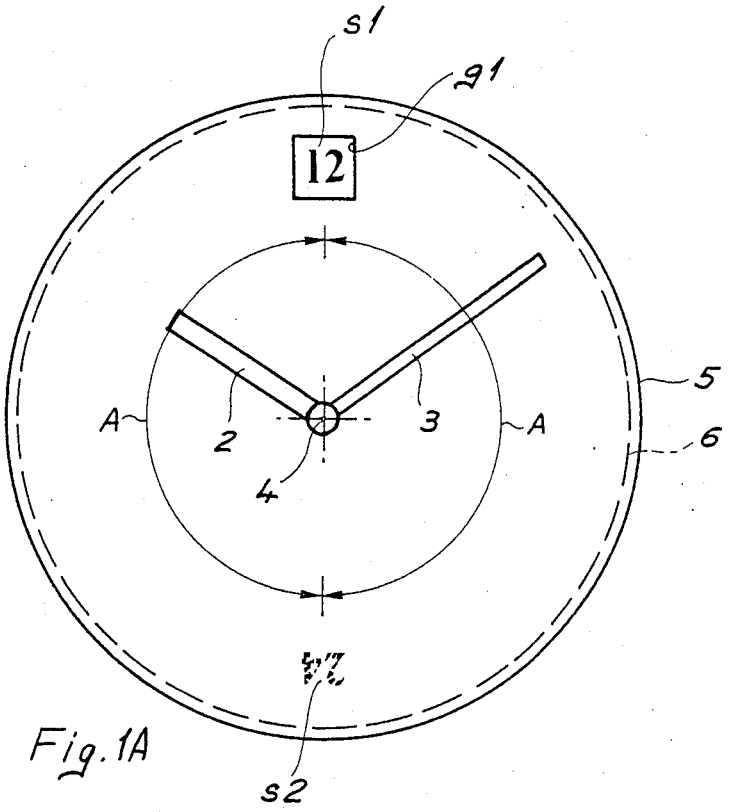

All illustrated forms of timepieces comprise a movement 1 that drives hours and minutes hands 2 and 3 and possibly also a seconds hand, not shown, about a common axis 4 before a dial 5.

Further, a disc 6 is mounted for rotary motion about axis 4 beneath dial 5, and is driven by a mechanism 7, that forms part of movement 1, in a manner that will be described from case to case.

Movement 1 and its link with hands 2 and 3 will not be described in detail as they may be of any kind and are not directly concerned by the invention. Suffice it to say that movement 1 drives hands 2 and 3 at the usual speeds of one revolution every twelve hours and of one revolution every hour.

Dial 5 is opaque except in one or more regions where it is transparent.

In the various embodiments hereinafter described, these transparent regions may for example consist of apertures formed in dial 5, in arrangements that will be described in greater detail from case to case.

The illustrated timepieces are of course meant to be housed in a case or a cabinet. The means used for this are neither described nor illustrated since they may also be of any known kind and are also not directly concerned by the invention.

The various elements of dial 5 and of disc 6 to which reference will be made hereinafter each occupy on dial 5 or on disc 6 a space of non negligible size.

To simplify the description, the position of each one such element will be equated with the position of a point located substantially at the centre of the space it occupies on dial 5 or on disc 6.

Also, the two angles that are formed by radii extending from the axis of rotation 4 to two elements of dial 5 or of disc 6, i.e. according to the above convention, the two angles that are formed by a pair of radii joining axis 4 to the points at the centre of the spaces occupied by these two elements on dial 5 or on disc 6. When necessary, one of these two angles will be differentiated from the other by indicating that it is being measured in a particular direction, which will also be stated, from one of the elements, which again will be stated.

Further, the twelve angular positions occupied by the hour numbers on the dial of a traditional timepiece will be referenced P1 to P12, position P1 being that occupied by number 1, position 2 being that occupied by number 2, etc., till position P12 which is that occupied by number 12.

Moreover, the expression "group of signs" will be used to designate all of the signs that are intended to appear in a non-fleeting manner in any one of the display apertures formed in the dial. The number of such groups of signs will thus always be equal to the number of apertures. Each group will include a first sign representing the number of the actual ongoing hour in a first half of a day when hand 2 is in the same angular position as the corresponding aperture, and at least a second sign representing the number of the actual ongoing hour in the second half of the day when hand 2 again is in the same angular position as the corresponding aperture. These two hours are of course separated by a time interval of twelve hours.

Figure 1B:
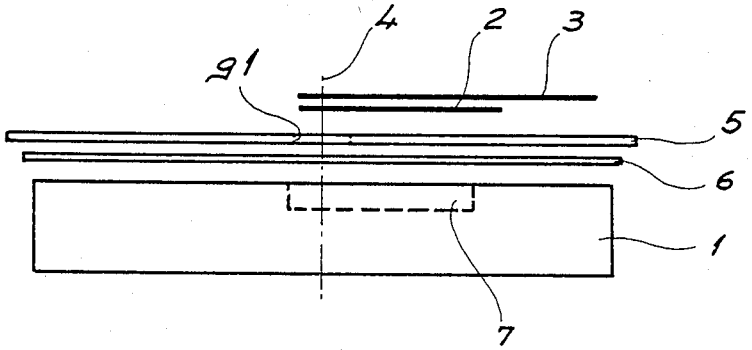

In the embodiment shown in FIGS. 1A and 1B, dial 5 is only formed with one aperture, referenced g1 and located in angular position P12.

Disc 6 therefore bears only one group of signs, which in this instance includes a single first sign s1 representing number 12, and a single second sign s2 representing number 24. Signs s1 and s2 are disposed at the periphery of the surface of disc 6 that faces dial 5, and form between them two angles of 180° both referenced A.

The size of signs s1 and s2, the distance between them and axis 4 and the size of aperture g1 are so chosen that signs s1 and s2 will appear successively through aperture g1 when disc 6 rotates.

As shown in FIG. 1 sign s1 is visible through aperture g1. Sign s2 has been drawn ghostlike as it is hidden by dial 5 and is normally invisible.

The mechanism 7 for driving disc 6 is so designed that disc 6, each day, will remain stationary between midnight and noon in the position where sign s1 is visible through aperture g1, that disc 6 will then quickly rotate, at precisely noon, through an angle equal to angle A, i.e. 180° in this embodiment, that disc 6 will remain stationary from noon till midnight in its new position in which sign s2 appears through aperture g1, and, finally, that disc 6 will again rotate through an angle equal to angle A, i.e. 180°, at precisely midnight such that sign s1 will reappear in aperture g1.

Thus, number 12 will be displayed in aperture g1 between midnight and noon and number 24 will be displayed between noon and midnight. The user of the timepiece will thus always know in which half of the day the time indicated by hands 2 and 3 is.

As will be appreciated, disc 6 can always rotate in the same direction, whether clockwise or anticlockwise. The mechanism 7 for driving disc 6 may thus be of simpler construction than the one used to alternately drive in opposite directions the disc that bears the numbers of the hours in the timepieces described in Swiss Patent Specifications 7197, 18199 and 59451 referred to earlier.

For instance, it is much simpler to design mechanism 7 in such a way that the rotational movements of disc 6 will always take place at exactly noon and at exactly midnight.

The mechanism 7 for driving disc 6 has not been shown in detail as the construction of such a mechanism will give rise to no particular difficulty to a man of the art who will be able to avail himself of various possible designs.

Mechanism 7 may for instance be entirely mechanical and be connected to the gear-train that serves to rotate hours-hand 2.

In such a case, mechanism 7 may for example comprise one of the well-known devices used to drive the ring that bears the numbers of the days of the month in timepieces of the jumping calendar type. Several such devices are described for instance in M. Th. Kühl's article entitled "Konstruktionssystematik bei Datumuhren" (Systematic analysis of the construction of date-watches) published in the journal "Jahrbuch der deutschen Gesellschaft für Chronometrie" (Annals of the German Society of Chronometry), volume 27 (1976), pages 121 to 172.

Mechanism 7 must of course be so connected to movement 1 that this device will operate every twelve hours, instead of every twenty-four as in calendar timepieces. Further, mechanism 7 must be arranged in such a way that disc 6 will rotate through 180° every time the device operates.

In many timepieces, movement 1 comprises a stepping motor that is supplied by a source of electric energy, such as a cell, and which drives hands 2 and 3 in response to periodic drive pulses supplied by a generator, which generally includes an oscillator and a frequency dividing circuit.

In such timepieces, the mechanism 7 for driving disc 6 may be entirely mechanical, like that described above. It may also comprise a second stepping motor which is supplied by the same source of electric energy as the first, and which drives disc 6 in response to other drive pulses supplied by the same electronic circuit.

This electronic circuit, in this case, is arranged to supply to the second motor a predetermined number of drive pulses that rapidly succeed one another at precisely noon and at precisely midnight. The gear-train connecting the second motor to disc 6 is so arranged that disc 6 will rotate 180° in response to these drive pulses.

In all other embodiments described hereinafter, the timepiece according to the invention comprises a movement 1 and hands 2 and 3 similar to those of the embodiment shown in FIG. 1. So as not unduly to clutter up the drawings, movement 1 and hands 2 and 3 have not been shown in the figures illustrating these other embodiments.

Figure 2:
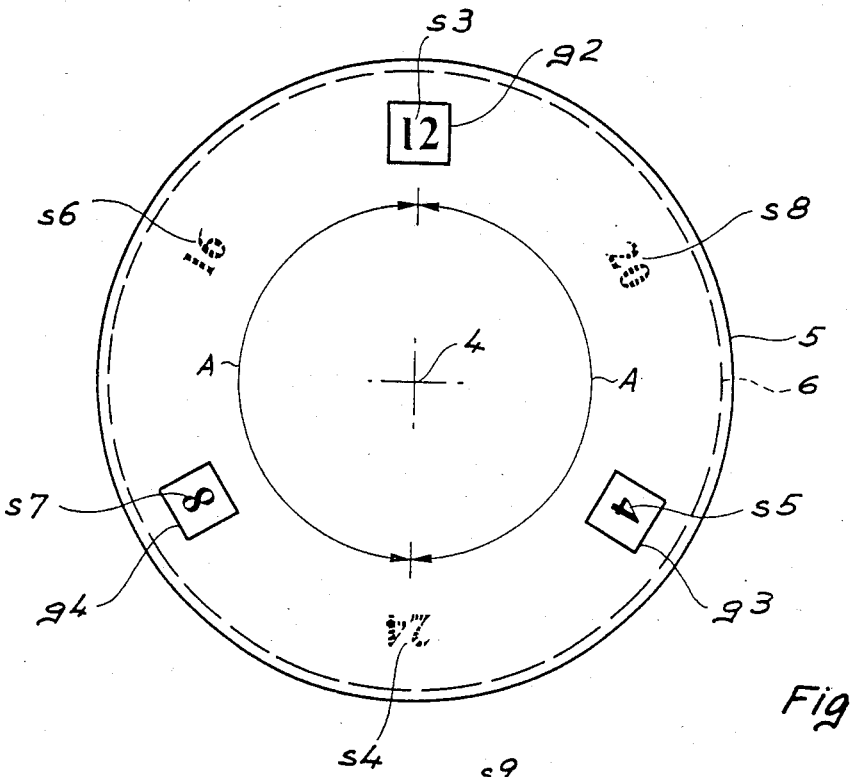

In the embodiment shown in FIG. 2, dial 5 is formed with three display apertures g2, g3 and g4 that are respectively located in positions P12, P4 and P8 and which thus form, each with each of the other two, an angle of 120°.

In concordance with the number of apertures, disc 6 bears three groups of signs. Signs s3 and s4 that form the first group are meant to be displayed in aperture g2 and represent numbers 12 and 24 respectively. Signs s5 and s6 that form the second group are meant to be displayed in aperture g3 and represent numbers 4 and 16 respectively. And signs s7 and s8 that form the third group are meant to be displayed in aperture g4 and represent numbers 8 and 20 respectively.

In concordance with the arrangement of display apertures g2 to g4, the first sign of each group forms with the first sign of each of the other groups an angle of 120°.

Additionally, the first sign and the second sign of each group form between them an angle of 180° also referenced A.

The mechanism 7 for driving disc 6, which is not shown in FIG. 2, is so designed that disc 6 will remain stationary between midnight and noon in the position shown in FIG. 2, that it will rotate rapidly at precisely noon through angle A, i.e. 180°, that it will then remain stationary till precisely midnight, and that it will again rotate rapidly through angle A, i.e. 180°, at that time.

Thus, numbers 12, 4 and 8 are respectively displayed in apertures g2, g3 and g4 between midnight and noon, and between noon and midnight it is numbers 24, 16 and 20 that are respectively displayed in apertures g2, g3 and g4. The user of the timepiece will therefore always know to which half of the day the time indicated by hands 2 and 3 belongs.

Obviously, during actual rotation of disc 6, signs other than those normally seen in apertures g2 to g4 will appear in the latter. If mechanism 7 is designed to impart a high rotational speed to disc 6, the signs as they move past the apertures will only appear fleetingly in those apertures in which they should not normally appear and this should not bother the timepiece user.

The mechanism 7 for driving the disc 6 of the timepiece shown on FIG. 2 will not be described in detail for it is similar to that described with reference to FIG. 1 and may be constructed in the same way.

As in the FIG. 1 embodiment, the direction of rotation of disc 6 is also optional since angle A between the two signs of each group is 180°.

As will be noted, it is not possible to produce a timepiece similar to those that have been described in which the number of apertures is even. This is because if this number were even, each aperture would form with another aperture an angle of 180°. The first sign of a group of signs and the second sign of another group of signs would then have to be in the same place on disc 6, which cannot of course be done.

Figure 3:
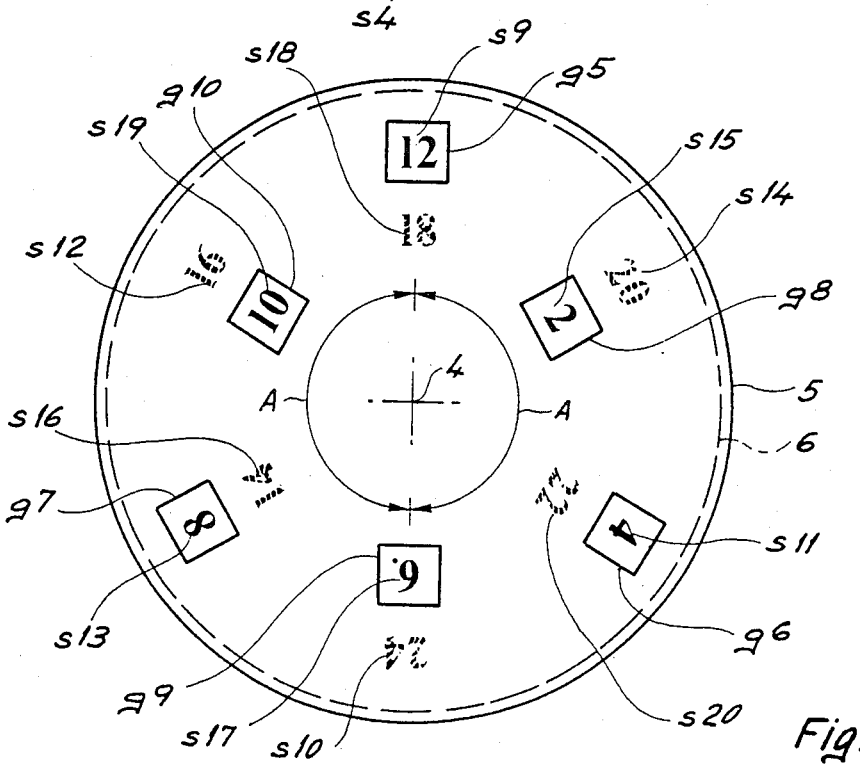

In the timepiece shown in FIG. 3, dial 5 is formed with a first set of three apertures g5 to g7 arranged in the same way as apertures g2 to g4 in FIG. 2, and with a second set of three apertures g8 to g10 respectively located in angular positions P2, P6 and P10, at a lesser distance from axis 4 than apertures g5 to g7, i.e. six apertures in all.

In concordance with this number of apertures, disc 6 in this embodiment bears six groups of signs, the first three being formed by signs s9 to s14 which are identical to signs s3 to s8 respectively in FIG. 2 and which are arranged likewise.

The fourth group is formed by signs s15 and s16 which are respectively located in the same angular positions as signs s14 and s13, at the same distance from axis 4 as apertures g8 to g10. They respectively represent numbers 2 and 14 and are intended to be displayed in aperture g8.

The fifth group is formed by signs s17 and s18 which are respectively located in the same angular positions as signs s10 and s9, at the same distance from axis 4 as apertures g8 to g10. They respectively represent numbers 6 and 18 and are intended to be displayed in aperture g9.

The sixth group is formed by signs s19 and s20 which are respectively located in the same angular positions as signs s12 and s11, at the same distance from axis 4 as apertures g8 to g10. They respectively represent numbers 10 and 22 and are intended to appear in aperture g10.

The angle A formed by the first sign and the second sign of each group is thus 180° as in FIG. 2.

The mechanism 7 for driving disc 6 is thus identical to that in FIG. 2, i.e. it will cause disc 6 to rotate through 180° at precisely noon and at precisely midnight such that numbers 12, 2, 4, 6, 8 and 10 will respectively be displayed in apertures g5 to g10 between midnight and noon and that numbers 24, 14, 16, 18, 20 and 22 will respectively be displayed between noon and midnight.

To embody the FIG. 3 arrangement in a small timepiece such as a wristwatch can cause problems because of the closeness of apertures g8 to g10 and of signs s15 to s20 to the rotational axis 4 of hands 2 and 3.

Figure 4:
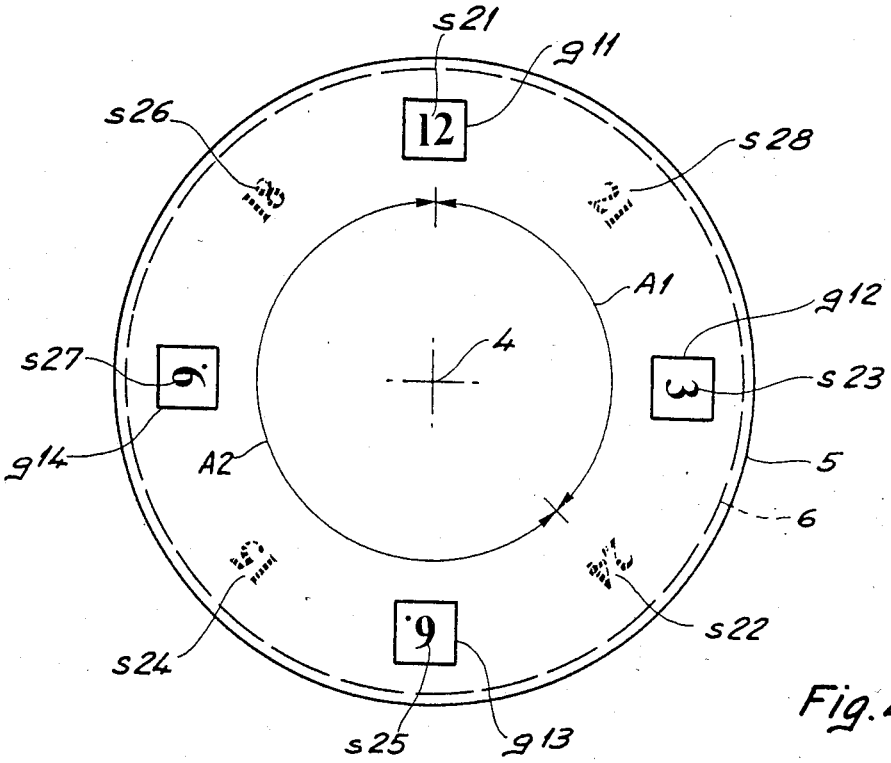

In the arrangement shown in FIG. 4 a larger number of apertures are again provided than in FIG. 2 but, unlike FIG. 3, all are regularly distributed near the periphery of dial 5 at a common distance from axis 4.

In this arrangement, dial 5 is formed with four display apertures g11 to g14 that are respectively located at positions P12, P3, P6 and P9, and disc 6 bears a corresponding number of groups of signs. The first of these groups includes signs s21 and s22, representing numbers 12 and 24 respectively. The second group includes signs s23 and s24, representing numbers 3 and 15 respectively. The third group includes signs s25 and s26, representing numbers 6 and 18 respectively. And the fourth group includes signs s27 and s28, representing numbers 9 and 21 respectively.

Figure 5:
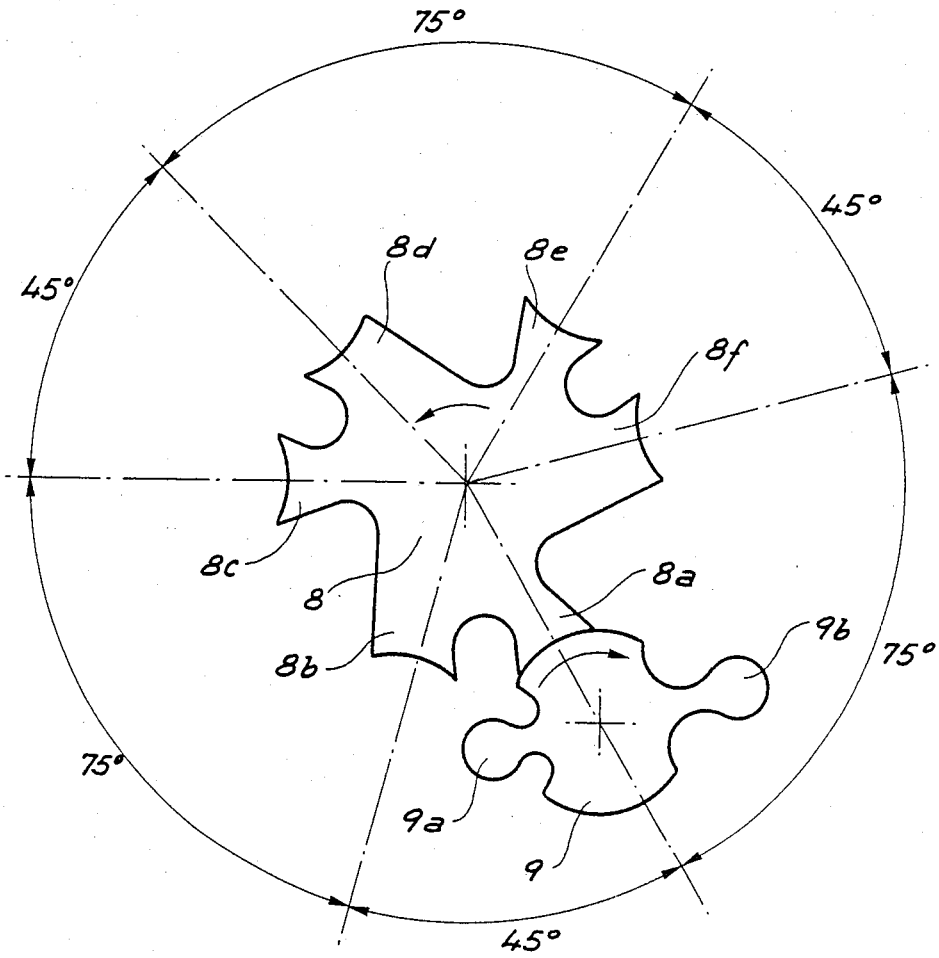

In concordance with the arrangement of apertures g11 and g14, the first signs of these four groups, i.e. signs s21, s23, s25 and s27, are arranged at 90° intervals along the periphery of disc 6 so that they can be displayed through apertures g11, g12, g13 and g14 when disc 6 is in the position shown in FIG. 5.

In each group, the first sign, s21, s23, s25 or s27, and the second sign, s22, s24, s26 or s28, form an angle A1 of 135°, this angle being measured in a clockwise direction from the first sign.

The mechanism 7 for driving disc 6 is so arranged that disc 6 will remain stationary in the FIG. 4 position from midnight till noon, will rotate quickly through an angle equal to A1, i.e. 135°, in an anticlockwise direction at precisely noon, will remain in this new position till precisely midnight, and will then, at that time, rapidly rotate through an angle A2 equal to (360° − A1), i.e. 225°, again in an anticlockwise direction.

Disc 6 thus occupies between midnight and noon the FIG. 4 position in which numbers 12, 3, 6 and 9 are respectively displayed in apertures g11 to g14, and, between noon and midnight, a second position in which numbers 24, 15, 18 and 21 are respectively displayed in these same apertures.

Anyone using this timepiece will therefore always know whether the time indicated by hands 2 and 3 is a.m. or p.m.

As in the previously described embodiments, the mechanism 7 for driving disc 6 in the FIG. 4 embodiment may be entirely mechanical and may then comprise a device similar to that shown in FIG. 5.

The FIG. 5 device is derived from the well-known Maltese cross arrangement and will not therefore be described in detail.

Suffice it to note that, in the FIG. 5 device, and unlike what is normally provided in known Maltese cross arrangements, arms 8*a* to 8*f* of driven wheel 8 do not form equal angles between them, but alternating angles of 45° and 75°, and driving wheel 9 has a pair of diametrically opposite driving fingers 9*a* and 9*b*.

Driven wheel 8 is connected to the disc 6 of FIG. 4 by a gear-train not shown, having a gear ratio of three.

Driving wheel 9 is connected to the movement by a mechanism, also not shown, that causes it to travel each day through half a revolution very quickly at precisely noon and at precisely midnight. Such a mechanism may be similar to mechanism 7 described above with reference to FIG. 1.

The above described gear-train and mechanism are designed so that, each day, wheel 8 will remain stationary from midnight till noon, will then rotate through 45° in response to the half-revolution travelled by wheel 9 at noon, will then remain stationary again from noon till midnight, and then will rotate through 75° in response to the half-revolution travelled by wheel 9 at midnight. These angular movements of 45° and 75° by wheel 8 respectively cause disc 6 to rotate through the above mentioned angles of 135° and 225°.

As in the previously described embodiments, the mechanism 7 for driving disc 6 in the FIG. 4 embodiment may comprise a stepping motor that is connected to disc 6 by a gear-train and which receives from an electronic control circuit a first plurality of drive pulses at noon and a second plurality of drive pulses at midnight. This gear-train and these pluralities of drive pulses are of course such that disc 6 will perform, at noon and at midnight, the above mentioned rotations of 135° and 225°.

Other embodiments of the timepiece according to the invention, similar to that shown in FIG. 4, may be made, but they must however satisfy certain conditions.

First, if their display apertures are evenly distributed around the periphery of dial 5 and are all equidistant from axis 4, the number of these apertures can only be a sub-multiple of 12, i.e. 1, 2, 3, 4, 6 or 12.

Further, if each group of signs only includes only one first sign and only one second sign, as in the aforedescribed embodiments, the following equation and inequations must be satisfied:

$$A1+A2=360° \quad (1)$$

$$A1 \neq AG_{i,j} \quad (2)$$

$$A2 \neq AG_{i,j} \quad (3)$$

wherein A1 and A2 are respectively the angle of rotation of disc 6 at noon and at midnight, and $AG_{i,j}$ is the angle formed by any two display apertures $g_i$ and $g_j$.

Equation 1 expresses the fact that disc 6 must perform one full revolution each day. Inequations 2 and 3 express the fact that any sign that is normally displayed in a particular aperture must never appear in another aperture otherwise than in a fleeting manner, during rotation of disc 6.

Equation 1 and inequations 2 and 3 show for instance that it is not possible to produce a timepiece according to the invention of the kind defined above in which the number of apertures is even and angles A1 and A2 are equal. If A1 and A2 were equal, equation 1 would suggest that they are both 180°. Further, if the number of apertures were even, there would always be one or more angles $AG_{i,j}$ of 180°. Inequations 2 and 3 would thus not be satisfied in such a case.

If the number of apertures were even, it would then be necessary to select unequal values for A1 and A2. This is what has been done in the case of FIG. 4. These unequal values for A1 and A2 may be chosen rather freely, the values of 135° and 225° given above merely being particular examples.

If equal values were chosen for A1 and A2, i.e. 180° for each, it would be necessary to have an uneven number of display apertures, i.e. either one, as in the case of FIG. 1, or three, as in the case of FIG. 2.

In cases such as that shown in FIG. 3, in which dial 5 includes two sets of apertures that are at different distances from axis 4, equation 1 and inequations 2 and 3 above must of course be satisfied for each set of apertures.

The above mentioned embodiments in which dial 5 is formed with 2, 6 or 12 display apertures will not be described since they can be made without difficulty from the above explanations.

Figure 6:
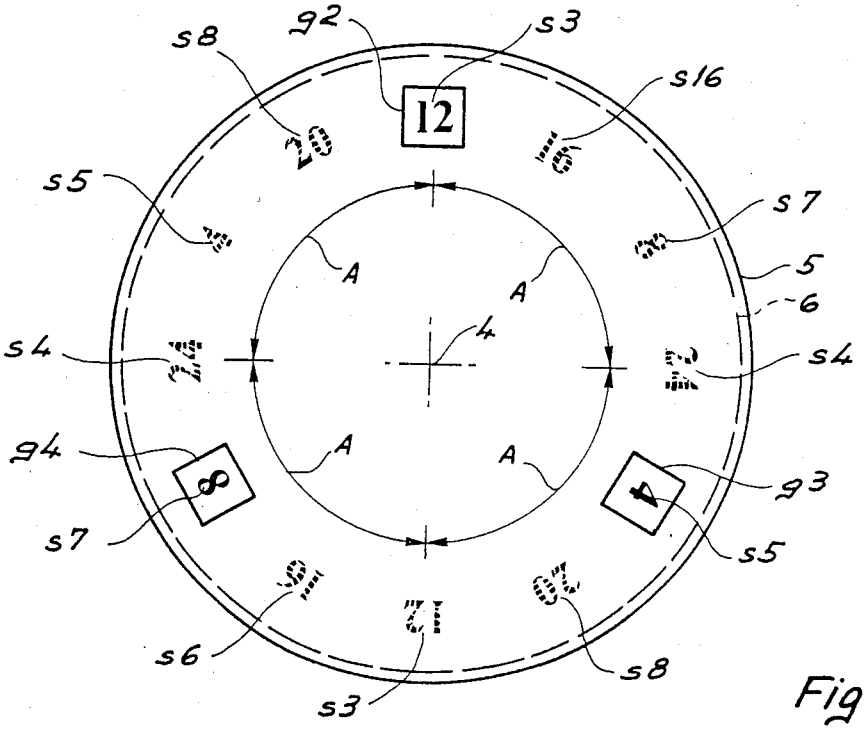
Figure 7:
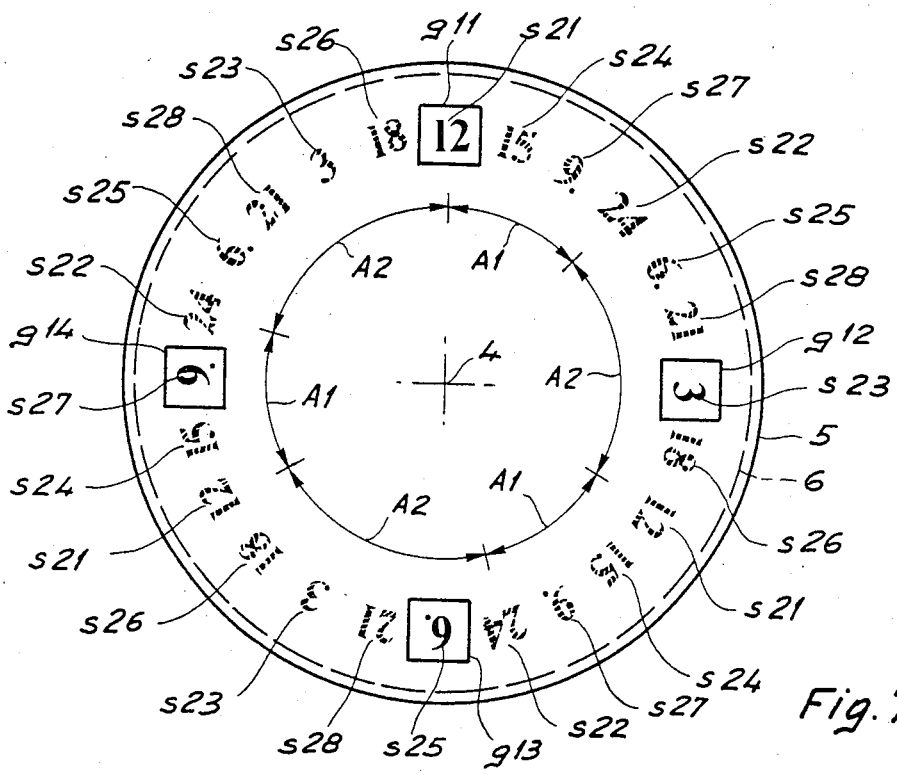

The timepiece embodiments that will now be described with reference to FIGS. 6 and 7 are modifications of those described with reference to FIGS. 2 and 4. They only differ from the latter in that each sign is repeated several times on disc 6 and that the mechanism 7 for driving disc 6 is correspondingly arranged.

Thus, in the FIG. 6 embodiment, dial 5 is formed with three display apertures that are disposed like those in the FIG. 2. embodiment and which are given the same references g2 to g4.

In concordance with this number of display apertures, disc 6 bears three groups of signs with each including two first signs and two second signs. The first and second signs of each group are respectively identical to the first sign and to the second sign of each group of signs in FIG. 2, and are given the same references s3 to s8.

In concordance with the arrangement of apertures g2 to g4, each first sign and each second sign of a group respectively form with a first sign and second sign of each of the other two groups an angle of 120°. Also, each first sign of each group forms with the two second signs of the same group angles A of 90°.

The mechanism 7 for driving disc 6 in FIG. 6 is of course so arranged that disc 6 will rotate through an angle equal to A above, i.e. 90°, at precisely noon and at precisely midnight. This mechanism will not be described in detail as it can easily be deduced from that described in connection with FIG. 2.

In the FIG. 7 embodiment, dial 5 is formed with four display apertures that are arranged as in the FIG. 4 embodiment and which are also referenced g11 to g14.

In concordance with this number of apertures, disc 6 bears four groups of signs that each include three first signs and three second signs. The first signs and the second signs of each group are respectively identical to the first sign and to the second sign of each group of signs in FIG. 4, and bear the same references s21 to s28.

In concordance with the arrangement of apertures g11 to g14, a first sign of each group forms with a first sign of two of the other three groups an angle of 90°, and with a first sign of the third of the other groups an angle of 180°, such that when a first sign s21 of the first group is displayed in aperture g11, a first sign s23 of the second group, a first sign s25 of the third group and a first sign s27 of the fourth group are respectively displayed in apertures g12, g13 and g14.

Each first sign, s21, s23, s25 or s27, forms with the second signs of the same group, s22, s24, s26 or s28, that are adjacent thereto, a first angle A1 of 45° and a second angle A2 of 75°, these angles being measured in an anti-clockwise direction from the first sign and from the second sign respectively.

The mechanism 7 for driving disc 6 in FIG. 7 is of course so designed that disc 6 will rotate in an anti-clockwise direction through an angle equal to angle A1 above, i.e. 45°, at precisely noon, and through an angle equal to angle A2 above, i.e. 75°, at precisely midnight. This mechanism 7 will not be described here in detail as it can readily be deduced from the one described with reference to FIG. 4.

The FIGS. 6 and 7 embodiments are by no means the only ones that can be designed with several identical signs on disc 6.

However, to be feasible, such timepieces have to satisfy certain conditions.

As in the FIGS. 2 and 4 embodiments, the number of display apertures can only be a sub-multiple of 12 if the apertures are regularly distributed along the periphery of dial 5.

In addition, the following equation and inequation have to be satisfied:

$$N\cdot(A1+A2)=360° \quad (4)$$

$$k\cdot A1+j\cdot A2\neq AG_{i,j} \quad (5)$$

In equation 4 and inequation 5, A1 and A2 are respectively, as before, the angles through which disc 6 rotates at noon and at midnight, and $AG_{i,j}$ is the angle formed by any two apertures $g_i$ and $g_j$. Further, N is the number of first signs, or of second signs, in each group of signs, k is a first integer such that $0 \leqq k \leqq N$, and j is a second integer equal to k or to $k+1$ and such also that $0 \leqq j \leqq N$.

Equation 4 expresses the fact that disc 6 must go through one complete revolution every N days and inequation 5 expresses the fact that any one sign that is normally displayed in a particular aperture must never appear in another aperture otherwise than in a fleeting way during rotation of disc 6.

It will be appreciated that equation 4 and inequation 5 respectively constitute a generalisation of equation 1 and of inequations 2 and 3 above, because if $N=1$, equation 4 becomes identical to equation 1, if $k=1$ and $j=0$, inequation 5 becomes identical to inequation 2, and if $k=0$ and $j=1$, inequation 5 becomes equal to inequation 3.

Equation 4 and inequation 5 again show that if the display apertures were evenly arranged around the periphery of dial 5 and that if their number were even, i.e. either 2, 4, 6 or 12, it would not be possible to select equal values for angles A1 and A2, since at least one angle $AG_{i,j}$ would then be equal to 180°. Further, if $A1=A2=A$, equation 4 could be written $N.2.A=360°$, or $A=180°/N$. For angle $AG_{i,j}$ that is equal to 180°, inequation 5 may be written $(k+j).180°/N\neq180°$. It will be observed that it will always be possible to find a number for k and a number for j that lie within the above defined values for which $(k+j)=N$, i.e. for which inequation 5 is not satisfied.

If the number of apertures is even, angles A1 and A2 must therefore be unequal.

Equation 4 and inequation 5 above also show that if the number of display apertures is three, as in FIGS. 2 and 6, the number N of first or second signs cannot be three or a multiple of three, since three of angles $AG_{i,j}$ would then be equal to 120°. And if, in addition, N were three or a multiple of three, it would be possible to write $N=3.M$ with M being any integer equal to or greater than 1, and equation 4 could be written $3.M.(A1+A2)=360°$, or $A1+A2=120°/M$. If, in addition, $k=j$, inequation 5 could be written for those angles $AG_{i,j}$ above that are equal to 120° as $k.(A1+A2)\neq120°$ or, substituting $(A1+A2)$ for the value obtained above for equation 4, as $k.120°/M\neq120°$. It will thus be noted that if $k=M$, inequation 5 would not be satisfied.

If the number of apertures were three, as in FIGS. 2 and 6, the number N of first signs or second signs in each group would have to be other than three or other than a multiple of three, regardless of the values that are selected for A1 and A2.

In cases similar to that of FIG. 3 in which dial 5 is formed with two sets of display apertures that are located at different distances from axis 4, the various groups of signs may of course each include a plurality of first signs and a plurality of second signs. Equation 4 and inequation 5 above must then be satisfied for each set of apertures.

In the embodiments shown in FIGS. 2 to 7 and in the various modifications thereof described above but not shown, the apertures that are formed in dial 5 are evenly arranged along its periphery.

There are many other possible forms of embodiment of the timepiece according to the invention in which the display apertures are not evenly arranged along the periphery of dial 5.

Figure 8:
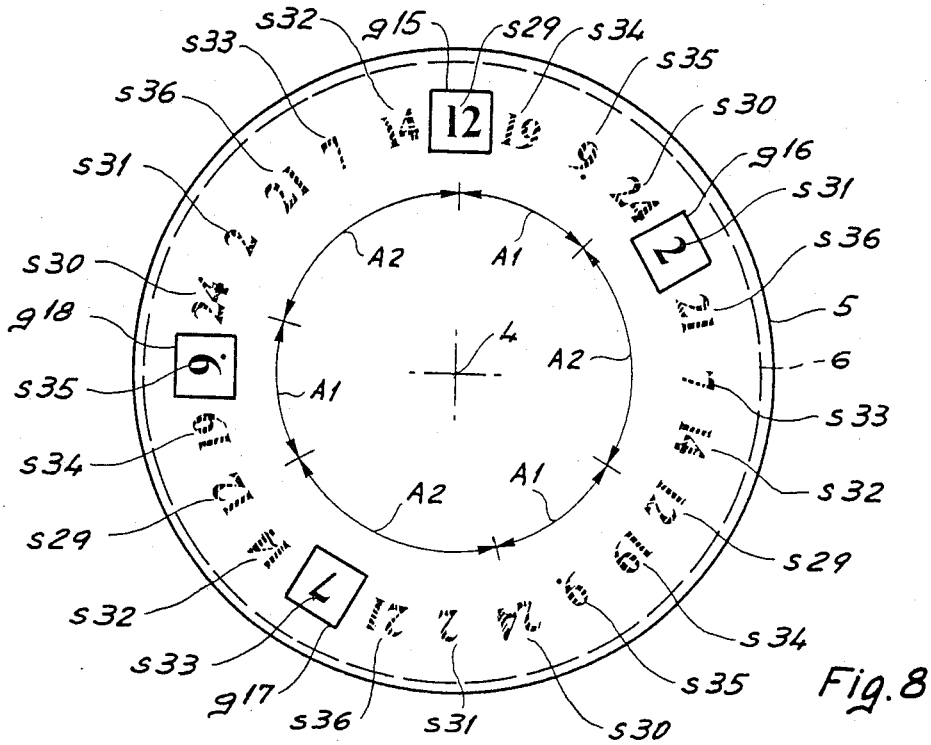

FIG. 8 for instance shows a timepiece according to the invention in which dial 5 is formed with four display apertures g15 to g18 that are respectively located in angular positions P12, P2, P7 and P9.

Disc 6 bears four groups of signs that include each three first signs s29, s31, s33 and s35 and three second signs s30, s32, s34 and s36. Signs s29 to s36 respectively represent numbers 12, 24, 2, 14, 7, 19, 9 and 21, and are arranged as shown in FIG. 8. Angles A1 and A2, which are respectively formed by each first sign with the two second signs adjacent thereto, have values of 45° and 75°.

The mechanism 7 for driving disc 6 is therefore similar to that in FIG. 7.

It will be appreciated that in embodiments which are similar to that of FIG. 8, i.e. in which the display apertures that are formed in dial 5 are not evenly arranged, equation 4 and inequation 5 above must also be satisfied.

It should be noted that if each sign only appears once on disc 6, i.e. if $N=1$ in equation 4 above, it is always possible to produce a timepiece according to the invention, whatever may be the number and the arrangement of the apertures. Since each of the latter is always located in one of angular positions P1 to P12, the angles $AG_{i,j}$ that they form are necessarily all multiples of 30°.

It therefore suffices to select for angle A1 a value equal to 15°.(2n+1), in which n is an integer such that $0 \leqq n \leqq 11$, and for angle A2 a value equal to (360°−A1) for equation 4 and inequation 5 to be satisfied.

Clearly, the signs borne by disc 6 must always be so selected as to represent the numbers of the hours indicated by hand 2 when it is in the same angular position as the apertures.

Many modifications may be made to the timepieces described and illustrated within the scope of the appended claims. These modifications have not been illustrated but some are listed below.

Thus, for example, angular position P12 is not necessarily occupied by a display aperture.

The shape of the display apertures may be other than that shown.

The display apertures may be formed by openings in an opaque layer provided on one face of a dial 5 made of a transparent material such as glass.

The signs representing number 24 may be replaced by signs representing number 0.

In embodiments such as those shown in FIGS. 2 to 4 and 6 to 8, the order of the signs on disc 6 may be reversed, mechanism 7 then being arranged to cause disc 6 to rotate in a direction opposite to that mentioned.

Also, in embodiments such as those shown in FIGS. 4, 7 and 8 in which angles A1 and A2 of rotation for disc 6 at noon and at midnight are not equal, mechanism 7 may be adapted to cause disc 6 to rotate in a direction opposite to that mentioned, through an angle A2 at noon and through an angle A1 at midnight, the order of the signs on disc 6 remaining as shown in these figures. Or else mechanism 7 may be adapted to cause disc 6 to rotate in the direction that has been mentioned, but again through an angle A2 at noon and through an angle A1 at midnight, the order of the signs on disc 6 then being reversed in relation to that shown.

Mechanism 7 may also be adapted to cause disc 6 to rotate at other times than noon and midnight, e.g. at six o'clock a.m. or six o'clock p.m. In such an event, the signs borne by disc 6 are of course correspondingly modified.

Disc 6 may itself be replaced by a crown similar to those that bear the numbers of the days of the month in most calendar timepieces.

Hands 2 and 3, and possibly the seconds hand, may be replaced by discs or other elements rotating about axis 4 and bearing any kind of pointer.

The signs representing the numbers of the hours may be so arranged on disc 6 that when the latter is stationary, they are all displayed in the apertures in a normal upright position and not in a more or less inclined position or even in an upside down position as shown in FIGS. 2 to 4 and 6 to 8.

I claim:

1. A timepiece comprising a movement, a dial, indicator means that are rotatably driven about an axis by said movement at the rate of one revolution every twelve hours and which cooperate with said dial to indicate during a first revolution the hours of a first half of a day and during a second revolution consecutive to the first revolution the hours of the second half of the day, and means for differentiating the hours of a first half of a day from the hours of the second half of the day and which include a first transparent region in said dial in a first angular position corresponding to the angular position occupied by said indicator means at a first set hour during said first half of a day and at a second set hour distant from said one set hour by a time interval of twelve hours, an element rotatable about said axis and disposed beneath said dial, a first group of signs disposed on said rotatable element facing said dial the same distance away from said axis as said first transparent region and which include a first sign representing the number of said first set hour and a second sign different from said first sign and representing the number of said second set hour, and means for driving said rotatable element that are connected to said movement and which are arranged to move said rotatable element at a first instant at the start of said first half of a day into a first position in which said first sign faces said first transparent region and at a second instant at the start of said second half of a day into a second position in which said second sign faces said first transparent region, and to maintain said rotatable element in said first position during said first half of a day and in said second position during said second half of the day, wherein the drive means are so arranged that said rotatable element will always rotate in the same direction.

2. A timepiece as in claim 1, wherein said first group of signs includes only one first sign and one second sign that form therebetween on said rotatable element a first angle and a second angle measured in a direction opposite to the direction of rotation of said rotatable element from said first and second signs respectively, and wherein said driving means are arranged to cause said rotatable element to rotate through an angle that is equal to said first angle at said first instant and through an angle that is equal to said second angle at said second instant.

3. A timepiece as in claim 1, wherein:

said first group of signs includes a plurality of first signs that are identical to said first sign and a plurality of second signs that are identical to said second sign and which are each disposed between two adjacent first signs;

each first sign forms on said rotatable element a first angle with the second sign that is closest thereto in a direction opposite to the direction of rotation of said rotatable element and a second angle with the second sign that is closest thereto in the same direction as the direction of rotation of said rotatable element, the product of the number of first signs times the sum of said first and second angles amounting to 360°; and said driving means are arranged to cause said rotatable element to rotate through an angle that is equal to said first angle at said first instant and through an angle that is equal to said second angle at said second instant.

4. A timepiece as in claim 1, wherein:

said means for differentiating the hours of the first half of a day from the hours of the second half of the day further include a second transparent region in said dial equally spaced from said axis as said first transparent region and in a second angular position corresponding to the angular position occupied by said indicator means at a third set hour during said first half of a day and at a fourth set hour distant from said third set hour by a time interval of twelve hours, said first and second transparent regions forming on said dial a first angle measured in a predetermined direction from said first transparent region, and a second group of signs disposed on said rotatable element facing said dial the same distance away from said axis as said first transparent region;

said first group of signs includes a single first sign and a single second sign;

said second group of signs includes a single third sign that differs from the other signs and which represents the number of said third set hour and a single fourth sign that differs from the other signs and which represents the number of said fourth set hour;

said first and third signs form therebetween on said rotatable element an angle which, when measured in said predetermined direction from said first sign, is equal to said first angle;

said first and second signs form therebetween on said rotatable element a second angle and a third angle respectively measured in a direction opposite to said direction of rotation of said rotatable element from said first sign and from said second sign respectively, the sum of said second and third angles amounting to 360° and each of said second and third angles being different from said first angle;

said third sign and said fourth sign form therebetween on said rotatable element two angles, measured in said direction opposite to said direction of rotation of said rotatable element from said third sign and from said fourth sign, which are respectively equal to said second and third angles; and said driving means are arranged to cause said rotatable element to rotate through an angle equal to said second angle at said first instant and through an angle equal to said third angle at said second instant.

5. A timepiece as in claim 1, wherein:

said means for differentiating the hours of the first half of a day from the hours of the second half of the day include a second transparent region which is formed in said dial the same distance away from said axis as said first transparent region and disposed in a second angular position corresponding to the angular position occupied by said indicator means at a third set hour during said first half of a day and at a fourth set hour distant from said third set hour by a time interval of twelve hours, said first and second transparent regions forming on said dial a first angle measured in a predetermined direction from said first transparent region, and a second group of signs disposed on said rotatable element facing said dial the same distance away from said axis as said first transparent region;

said first group of signs includes a plurality of first signs that are identical to said first sign and a plurality of second signs that are identical to said second sign and which are each disposed between two adjacent first signs;

each first sign forms on said rotatable element a second angle with the second sign that is closest thereto in a direction opposite to the direction of rotation of said rotatable element and a third angle with the second sign that is closest thereto in the same direction as the direction of rotation of said rotatable element, the product of the number of the first signs times the sum of said second and third angles amounting to 360°, and the sum of the product of the second angle times a first integer greater than or equal to zero and less than or equal to the number of first signs and of the product of the third angle times a second integer greater than or equal to zero, less than or equal to the number of first signs and equal to the first number or to the first number plus or minus one being different from said first angle;

said second group of signs includes a plurality of third signs that are identical to one another, which are different from the other signs and which represent the number of said third set hour, and a plurality of fourth signs that are identical to one another, which are different from the other signs, which represent the number of said fourth set hour and which are each disposed between two adjacent third signs, the numbers of said third signs and of said fourth signs being equal to the number of said first signs;

each third sign forms on said rotatable element, with the fourth sign that is closest thereto in a direction opposite to the direction of rotation of said rotatable element, an angle equal to said second angle and, with the fourth sign that is closest thereto in the same direction as the direction of rotation of said rotatable element, an angle equal to said third angle;

each first sign forms on said rotatable element, with a third sign, an angle which, when measured in said predetermined direction, is equal to said first angle; and said driving means are arranged to cause said rotatable element to rotate through an angle equal to said second angle at said first instant and through an angle equal to said third angle at said second instant.

6. A timepiece as in claim 1, wherein:

said means for differentiating the hours of the first half of a day from the hours of the second half of the day include a second transparent region in said dial at a distance from said axis different from the distance between said first transparent region and said axis and at a second angular position corresponding to the angular position occupied by said indicator means at a third set hour during the first half of a day and at a fourth set hour distant from said third set hour by a time interval of twelve hours, said first and second transparent regions forming on said dial a first angle measured in a predetermined direction from said first transparent region, and a second group of signs disposed on said rotatable element facing said dial the same distance away from said axis as said second transparent region and including a third sign that is different from the other signs and which represents the number of said third set hour and a fourth sign which is different from the other signs and which represents the number of said fourth set hour;

said first and third signs form therebetween on said rotatable element an angle which, when measured in said predetermined direction from said first sign, is equal to said first angle;

said first and second signs form therebetween on said rotatable element second and third angles, measured in a direction opposite to said direction of rotation of said rotatable element from said first and second signs respectively;

said third and fourth signs form therebetween on said rotatable element two angles which, when measured in said direction opposite to the direction of rotation of said rotatable element from said third and fourth signs respectively, are respectively equal to said second and third angles; and said driving means are arranged to cause said rotatable element to rotate through an angle equal to said second angle at said first instant and through an angle equal to said third angle at said second instant.

* * * * *